US005429764A

United States Patent [19]

Van Vlahakis et al.

[11] Patent Number: 5,429,764

[45] Date of Patent: Jul. 4, 1995

[54] LIQUID DRAIN OPENER COMPOSITIONS BASED ON SULFURIC ACID

[75] Inventors: Eftichios Van Vlahakis, 16727 Bolero La., Huntington Beach, Calif. 92649; John A. Manolas, Lake Forest, Ill.

[73] Assignee: Eftichios Van Vlahakis, Huntington Beach, Calif.

[21] Appl. No.: 111,130

[22] Filed: Aug. 24, 1993

[51] Int. Cl.[6] ..... C11D 7/08; C11D 3/04

[52] U.S. Cl. ..... 252/146; 252/142; 252/143; 252/147; 252/148; 252/151

[58] Field of Search ..... 252/142, 146, 143, 147, 252/148, 151

[56] References Cited

U.S. PATENT DOCUMENTS

| | | | |
|---|---|---|---|
| 2,997,444 | 8/1961 | Martin . | |
| 3,538,008 | 11/1970 | Ancel et al. | 252/146 |
| 3,666,670 | 5/1972 | Gilbert et al. | 252/158 |
| 3,968,048 | 7/1976 | Bolan | 252/142 |
| 3,993,804 | 11/1976 | McCready et al. | 252/142 |
| 4,004,066 | 1/1977 | DeArdo | 428/538 |
| 4,096,871 | 6/1978 | Van Clahakis | 134/40 |
| 4,386,004 | 5/1983 | Jenkins | 252/145 |
| 4,426,003 | 1/1984 | Zarov | 252/90 |
| 4,435,223 | 3/1984 | Dollman | 252/142 |
| 4,453,983 | 6/1984 | Berkeley | 134/22.14 |
| 4,498,933 | 2/1985 | Berkeley | 134/22.14 |
| 4,587,032 | 5/1986 | Rogers | 252/174.17 |
| 4,666,625 | 5/1987 | Shaer et al. | 252/146 |
| 4,818,298 | 4/1989 | Shishkin et al. | 134/22.11 |
| 4,993,442 | 2/1991 | Young | 134/22.14 |
| 5,106,524 | 4/1992 | Haskell, III | 252/142 |
| 5,264,146 | 11/1993 | Tobiason | 252/157 |

OTHER PUBLICATIONS

3M Brochure entitled "Presenting the solutions for your problems.", 1992 (no month available).

Material Safety Data Sheet for Rodine® 95, date at least as early as Aug. 24, 1993.

*Primary Examiner*—Paul Lieberman

*Assistant Examiner*—A. Hertzog

*Attorney, Agent, or Firm*—Wallenstein & Wagner, Ltd.

[57] ABSTRACT

The present invention relates to a composition and method for opening clogged drains. Specifically, the liquid drain opener composition of the present invention comprises about 70%-93% by weight sulfuric acid; about 1%-23% by weight water; about 0.01%-5% by weight of at least one corrosion inhibiting agent; and, about 0.01%-28.99% by weight of at least one surfactant. The drain opener composition may also contain mineral oil and inert filler materials, such as salt. The present invention is also directed to a method of opening clogged drains comprising the steps of contacting a clogged drain with the liquid drain opener composition of the present invention; the composition applying a protective coating to metal surfaces of the drain to substantially prevent corrosion of the metal; the composition applying a protective coating to concrete surfaces of the drain to substantially prevent erosion of the concrete; and, flushing the dissolved clog with water.

15 Claims, No Drawings

LIQUID DRAIN OPENER COMPOSITIONS BASED ON SULFURIC ACID

DESCRIPTION

1. Technical Field

The present invention relates to a composition and method for opening clogged drains, and more particularly to a drain opener composition and method having improved anti-corrosion of metal and anti-erosion of concrete properties. Specifically, the drain opener composition of the present invention comprises an aqueous solution of sulfuric acid, water, one or more corrosion inhibiting agents, and one or more surfactants. Optionally, the drain opener composition may also contain mineral oil and inert filler materials. The present invention is also directed to a method of opening clogged drains by contacting drains with the drain opener composition of the present invention, thereby applying a protective coating to metal surfaces to prevent metal corrosion and applying a protective coating to concrete surfaces to prevent concrete erosion.

2. Background Prior Art

Domestic and industrial drains of all types, particularly in bathrooms, kitchens, and utility sinks or tubs, often become clogged or completely plugged with organic and/or inorganic debris, impurities, corrosion, and components of the fluid passed through the drains. Most liquid drain openers in common use are composed primarily of a concentrated solution of a strong base or acid. It is known that acids, particularly strong acids such as sulfuric acid, have the ability to degrade a wide variety of substances normally found in domestic and industrial drains. Sulfuric acid has been used to dissolve a variety of inorganic deposits such as metal salts, carbonates and other materials, and also has been used to chemically attack and weaken a variety of organic deposits, thereby facilitating the removal of such deposits.

The properties of sulfuric acid which make it effective for drain cleaning includes its high heat of dilution in contact with residual water in the drain, which melts fats, greases and low melting point compounds that otherwise act as clogging sites for other debris; its reactivity with a wide range of functional groups such as hydroxyls, carbonyls, esters, unsaturated bonds, rings and amino groups; its ability to hydrolyze protein; and celluloses and convert insoluble salts to soluble salts; its ability to react with carbonates to liberate carbon dioxide, thereby producing turbulence; and, its high dissociation constant that helps dissolve many organic and inorganic materials.

Although sulfuric acid is one of the strongest, readily available acids for use in the removal of obstructions from drains, sulfuric acid has the disadvantage of being highly corrosive and therefore difficult to handle. Sulfuric acid promotes a variety of side reactions with many materials including dehydration, sulfonation, and oxidation, in which it is consumed, thereby eliminating its activity as an active chemical agent. Its heat of dilution in many solvents, particularly in water, and its rate and heat of reaction with many deposits, are also very high. Thus, sulfuric acid is highly corrosive to metal pipes and can also cause erosion of concrete.

At high concentrations, i.e., greater than 93% by weight, sulfuric acid causes severe burning and rapid destruction of tissue when in contact with skin. The fumes or mists from sulfuric acid also cause coughing and irritation of the mucous membranes of the eyes and respiratory tract. In addition, sulfuric acid concentrations of greater than 93% by weight generate large amounts of heat which cause dangerous explosive conditions and can cause cracking of toilets or fixtures and leaking of pipes.

Prior art drain cleaning compositions containing acids are known. For example, U.S. Pat. Nos. 4,453,983 and 4,498,933, both to Berkeley, are directed to diphase drain cleaning compositions having two layers of solution, with the lower layer comprising at least 20% sulfuric acid solution. U.S. Pat. No. 4,096,871 to Vlahakis discloses a drain opening composition comprising a solution of 80.8% to 84.5% sulfuric acid, and U.S. Pat. No. 3,968,048 to Bolan discloses a drain cleaning composition comprising 10 to 40 parts of an acidic agent, the acidic agent being sodium bisulfate or citric acid.

Methods for cleaning clogged drains and removing deposits from conduits with the use of acids are also known in the art. U.S. Pat. No. 4,666,625 to Shaer et al. discloses a method of cleaning clogged drains using a composition of 5% to 95% of an acid, which may be sulfuric acid. U.S. Pat. No. 4,993,442 to Young discloses a method for removing obstructions from conduits using a reaction product of sulfuric acid and a chalcogen-containing compound. U.S. Pat. No. 4,818,298 to Shishkin et al. discloses a method of removing deposits from pipes and applying protective coatings thereto by using a corrosion inhibitor which may comprise an aqueous solution containing phosphoric acid.

Finally, methods and compositions for treating and coating concrete with the use of acids are known in the art. U.S. Pat. No. 4,004,066 to DeArdo discloses a method of protecting concrete using an aqueous solution of citric acid, and U.S. Pat. No. 4,386,004 to Jenkins discloses a composition for treating concrete comprising an aqueous mixture containing muriatic acid.

However, prior art compositions and methods for cleaning and opening clogged drains, as well as prior art compositions and methods for treating concrete, fail to provide for a single composition or method that combines the properties of preventing corrosion of metal and preventing erosion of concrete, while providing for a safe but effective concentration of sulfuric acid.

Therefore, a need exists for a composition and method for opening clogged drains which utilizes a strong acid, such as sulfuric acid, in combination with metal corrosion inhibiting agents and concrete erosion inhibiting agents. There is also a need for an effective drain opener composition and method that uses a concentration of sulfuric acid which is safe to humans and safe for pipes, fixtures, and drains in general. The present invention is an improvement over the prior art in that none of the prior art inventions disclose a 70%-93% concentration of sulfuric acid, in combination with additives for inhibiting the corrosion of metals and the erosion of concrete surfaces. The addition of corrosion inhibiting agents, such as Rodine 213 and/or Rodine 95, or such as Armohib, to the drain opener composition of the present invention prevents or highly decreases the likelihood of corrosion of metal surfaces caused by the sulfuric acid. The addition of one or more surfactants in the present invention also prevents or highly decreases the likelihood of corrosion of metal surfaces, as well as prevents or highly decreases the likelihood of erosion of concrete surfaces caused by the sulfuric acid. Although the use of sulfuric acid in the present composition is effective in unclogging and cleaning drains, in order to make the composition safe for human use and safe for piping, metals, concrete and fixtures, the sulfuric acid is effectively diluted with water to form an aqueous solution. In addition, mineral oil may optionally be added to the composition of the present invention to prevent or decrease odors formed during reactions between the sulfuric acid and waste matter commonly found in sewers and drainage pipes.

Thus, the present invention overcomes the deficiencies associated with the prior art by providing an improved composition and method for opening clogged drains that is safe and effective.

SUMMARY OF THE INVENTION

The present invention relates to a composition and method for opening clogged drains. Specifically, the liquid drain opener composition of the present invention comprises about 70%-93% by weight sulfuric acid; about 1%-23% by weight water; about 0.01%-5% by weight of at least one corrosion inhibiting agent; and, about 0.01%-28.99% by weight of at least one surfactant. The drain opener composition may also contain mineral oil and inert filler materials, such as salt.

The present invention is also directed to a method of opening clogged drains comprising the steps of contacting a clogged drain with the liquid drain opener composition of the present invention; the composition thereby applying a protective coating to metal surfaces of the drain to substantially prevent corrosion of the metal; the composition thereby applying a protective coating to concrete surfaces of the drain to substantially prevent erosion of the concrete; and, flushing the dissolved clog with water.

One aspect of the present invention is to provide a drain opener composition comprising an aqueous solution of concentrated sulfuric acid which has preferably been diluted with water to a concentration of 85% by weight sulfuric acid, a concentration which is strong enough to dissolve typical drain clogging materials without posing an extreme danger of acid burns to humans and damage to drain pipes and fixtures.

Another aspect of the present invention is to provide a drain opener composition containing at least one corrosion inhibiting agent, such as Rodine 213 and/or Rodine 95, or such as Armohib, which acts to coat and substantially protect metal pipes and drains from the corrosive effects of the sulfuric acid.

Another aspect of the present invention is to provide a drain opener composition containing at least one surfactant, such as the nonionic surfactant Igepal CO-630, which also acts to coat and substantially prevent corrosion of metal, as well as acts to coat and substantially prevent erosion of concrete, when a concrete surface of the drain is exposed to sulfuric acid.

Another aspect of the present invention is to provide a drain opener composition which may optionally contain a mineral oil that floats on top of the sulfuric acid and forms a cap layer to decrease the release of unpleasant odors formed during reactions between the sulfuric acid and waste matter commonly found in sewers and drainage pipes.

Another aspect of the present invention is to provide a method of opening and cleaning clogged drains, through the contact of a clogged drain with the aqueous sulfuric acid drain opener composition of the present invention.

Another aspect of the present invention is to provide a simple, economical process of manufacturing the drain opener composition of the present invention.

Other features and advantages of the present invention will be apparent upon reading the following detailed description of the invention and preferred embodiments of the invention.

DETAILED DESCRIPTION OF THE PREFERRED EMBODIMENT

This invention is susceptible of embodiments in various different forms. The specification describes in detail a preferred embodiment of the invention. It is to be understood that the present disclosure is to be considered as an exemplification of the principles of the invention. It is not intended to limit the broad aspects of the invention to the illustrated embodiment.

All percentages of components or phases given herein are weight percentages of the entire drain opener composition, unless otherwise indicated.

The liquid drain opener composition of the present invention, in its broadest form, comprises about 70%-93% by weight sulfuric acid; about 1%-23% by weight water; about 0.01%-5% by weight of at least one corrosion inhibiting agent; and, about 0.01%-28.99% by weight of at least one surfactant. The drain opener composition may also contain mineral oil and inert filler materials.

The drain opener composition of the present invention contains sulfuric acid in a range of from about 70% by weight of the composition to about 93% by weight of the composition. The preferred amount of sulfuric acid is about 85% by weight of the composition. The sulfuric acid is initially received in raw material form at a 93% concentration, that is, a 100% concentration of sulfuric acid diluted with 7% water (of the total weight of water and acid). To obtain a safe and effective concentration for the composition of the present invention, the sulfuric acid is further diluted with about 8% water to obtain the preferred 85% by weight sulfuric acid concentration. The use of sulfuric acid in an amount below 70% by weight has been found to be an insufficient concentration to clear and unclog drains in an adequate manner. However, the use of sulfuric acid in an amount above 93% by weight has been found to be too high a concentration and has been found to create excess heat which poses a danger to human tissue, as well as drain pipes and fixtures.

The drain opener composition of the present invention also contains water in an amount of from about 1% to about 23% by weight of the composition. The preferred amount of water used is about 8% by weight of the composition. The water is used to dilute the sulfuric acid, as initially received in its 93% aqueous solution raw material form. The amount of water required to dilute the sulfuric acid to the preferred 85% by weight concentration is approximately 8% water by weight of the composition. However, the amount of water added to the 93% sulfuric acid solution may be reduced if a higher concentration of sulfuric acid is desired, i.e., if the concentration of sulfuric acid is increased to 90% by weight, the amount of water used is reduced to about 3% by weight. Conversely, the amount of water added to the 93% sulfuric acid solution may be increased if a lower concentration of sulfuric acid is desired, i.e., if the concentration of sulfuric acid is decreased to 70% by weight, the amount of water used is increased to about 23% by weight.

The drain opener composition of the present invention also contains one or more corrosion inhibiting agents to substantially protect metal pipes and drains from metal corrosion. The preferred corrosion inhibiting agents for use in the composition of the present invention include Rodine 213 and/or Rodine 95. Rodine 213 is a liquid organic cationic corrosion inhibitor manufactured by Parker-Amchen. RODINE 95 comprises the comprises the components of substituted triazine at about 40–50% by weight, hydrochloric acid at about less than 15% by weight, thiourea at about 1–5% by weight, formaldehyde at about less than 1% by weight, and orthotoluidine at about less than 1% by weight. Rodine 95 is a foaming liquid inhibitor, also manufactured by Parker-Amchen. It has been found that both Rodine 213 and Rodine 95 are suitable for use in the present drain opener composition, either individually or in combination. The amount of corrosion inhibiting agent or agents suitable for use in the present composition is in an amount of from about 0.01% by weight of the composition to about 5% by weight of the composition. Due to the fact that Rodine is very expensive in cost, the preferred amount of Rodine 213 and/or Rodine 95 suitable for use in the present invention is in an amount of about 0.1% by weight of the composition.

The drain opener composition of the present invention also requires the use of one or more surfactants. The surfactants suitable for use with the present invention include nonionic, cationic, amphoteric, and fluorinated surfactants. A single surfactant or a combination of surfactants may be used in the composition of the present invention. The amount of surfactant(s) suitable for use in the present composition is in an amount of from about 0.01% by weight of the composition to about 28.99% by weight of the composition. The preferred amount of surfactant(s) suitable for use in the present composition is in an amount of about 0.5% by weight of the composition. For economic reasons, 0.5% by weight of a surfactant is preferable to use of a greater amount of surfactant. It should be noted that the presence of surfactant(s) in a greater amount, such as in an amount of 1% by weight, causes no difference in the efficacy of the composition. The use of one or more surfactants in the present invention has been found to coat metal surfaces and substantially prevent corrosion of metal caused by sulfuric acid. In addition, the use of one or more surfactants has been found to coat and substantially prevent erosion of concrete surfaces of drains that are exposed to the sulfuric acid.

The choice between the nonionic, cationic, amphoteric, or fluorinated surfactants is also largely based upon the cost of the various materials. Petroleum-based nonionic surfactants, such as Igepal CO-630 are preferred over other nonionic, cationic, amphoteric, and fluorinated surfactants due to their lower cost and ready availability. Igepal CO-630 is a 9 mol ethylene oxide surfactant manufactured by Rhone Poulenc. The chemical formula for Igepal CO-630 is nonylphenol plus 9 mol ethylene oxide polyethoxylate. Igepal CO-630 is also known as Nonoxynol 9. The nonionic surfactant Tergitol NP-9 manufactured by Union Carbide is equivalent to and may be substituted for Igepal CO-630.

Other nonionic surfactants suitable for use in the present composition include Igepals having from about 4 mols of ethylene oxide to about 100 mols of ethylene oxide. However, the Igepals having lower mols of ethylene oxide are preferred due to ease of use, since nonionic surfactants having higher mols of ethylene oxide are solid and must be diluted with water before use.

Amphoteric surfactants suitable for use in the composition of the present invention include Lonzaine C and Lonzaine CO manufactured by Lonza, and Monateric 1000 manufactured by Mona Industries. Lonzaine C and Lonzaine CO are chemically known as cocoamidopropyl betaines. Monateric 1000 is chemically known as an alkyl imidazoline. However, these amphoteric surfactants are less preferable for use in the present invention, as they are more expensive in cost than the nonionic surfactants discussed above.

Cationic surfactants suitable for use in the composition of the present invention include Varine C and Varine O both manufactured by Sherex Chemical. Varine C is a cocohydroxyethyl imidazoline. Varine O is an oleyl imidazoline. These cationic surfactants are less preferable for use in the present invention, as they are more expensive in cost than the nonionic surfactants discussed above.

The fluorinated surfactants suitable for use in the composition of the present invention include various fluorocarbon surfactants manufactured by 3M Company. The fluorocarbon surfactants suitable for use in the present invention include: FC-93 (anionic, ammonium perfluoroalkyl sulfonates); FC-95 and FC-98 (anionic, ammonium perfluoroalkyl sulfonates); FC-99 (anionic, amine perfluoroalkyl sulfonates); FC-135 (cationic, fluorinated alkyl quaternary ammonium iodides); FC-170C (nonionic, fluorinated alkyl polyoxyethylene ethanols); and, FC-171 (nonionic, fluorinated alkyl alkoxylate). These fluorocarbon surfactants are less preferable to use in the present invention than the nonionic surfactant discussed above, due to the expensive cost. In addition, some of these fluorocarbon surfactants contain alleged potentially carcinogenic elements.

Optionally, the drain opener composition of the present invention may also contain a mineral oil in an effective amount of less than 1% by weight. The preferred amount of mineral oil suitable for use in the present invention is in an amount of about 0.5% by weight. The mineral oil suitable for use in the composition of the present invention is Carnation White Mineral Oil manufactured by Penreco. The mineral oil floats on top of the sulfuric acid and forms a cap layer over the sulfuric acid layer. Thus, the mineral oil acts to decrease the release of unpleasant odors formed during reactions between the sulfuric acid and waste matter commonly found in sewers and drainage pipes. However, the addition of mineral oil is optional, since the addition of mineral oil increases the mixing or processing time, and thus increases the cost of manufacturing the product. In addition, at a sulfuric acid concentration at or below 85%, less heat is created, and therefore the mineral oil as a cap layer is not required.

Other optional components that may be added to the drain opener composition of the present invention include inert filler materials, such as salts. The inert filler materials are typically added for cosmetic reasons or to lower the cost of the formulation. The inert materials, if added, are in trace amounts of less than 1% by weight of the composition.

The present invention is also directed to a method of opening clogged drains. The method comprises the steps of contacting a clogged drain with an aqueous sulfuric acid composition comprising from about 70% by weight to about 93% sulfuric acid; from about 1% by weight to about 23% by weight water; from about 0.01% by weight to about 5% by weight of at least one corrosion inhibiting agent; and, from about 0.01% by weight to about 28.99% by weight of at least one surfactant, to dissolve said clog; the composition applying a protective coating to metal surfaces of the drain to substantially prevent corrosion of the metal; the composition applying a protective coating to concrete surfaces of the drain to substantially prevent erosion of the concrete; and, flushing the dissolved clog with water. The corrosion inhibiting agent of the present composition acts to provide a protective coating to metal surfaces of the drain to substantially prevent corrosion of the metal by the sulfuric acid. The surfactant(s) of the composition also act(s) to provide a protective coating to metal surfaces of the drain to substantially prevent corrosion of metal, and also act(s) to provide a protective coating to the concrete surfaces of the drain to substantially prevent erosion of the concrete by the sulfuric acid.

The manufacture of the drain opener composition of the present invention is simple and economical. Typically, the sulfuric acid is received in a raw form at a concentration of 93% by weight. The temperature of the sulfuric acid received in this form is approximately the same temperature as the external surrounding temperature.

The sulfuric acid as received is contained in large tanks having a capacity of approximately 1,000 gallons or 1,200 gallons. The sulfuric acid is then transferred with a gear transfer pump from the 1,000 gallon or 1,200 gallon tanks to smaller 50 gallon or 100 gallon mixing tanks. The mixing tanks are filled with an amount of sulfuric acid necessary to produce the desired amount of drain opener composition.

Preferably, the desired amount of water to be used for further dilution of the raw 93% sulfuric acid is already in the mixing tank, so that the 93% sulfuric acid is then added to the water. However, in the alternative, the desired amount of water may also be slowly added to the 93% sulfuric acid after the sulfuric acid has been already pumped into a desired mixing tank. Preferably, an effective amount of water at room temperature is used to dilute the 93% sulfuric acid solution to obtain a sulfuric acid concentration of about 85% by weight. No additional heating or cooling of the water, or other components, is necessary, since when the water is mixed with the sulfuric acid, an exothermic reaction takes place and heat is generated. Under certain conditions, temperatures as high as 200° F. have been reached during the mixing of the water and sulfuric acid for the composition of the present invention.

The sulfuric acid and water is initially mixed with preferably a 316 stainless steel electric mixer for approximately thirty (30) minutes. After mixing the sulfuric acid and water with the electric mixer, the sulfuric acid/water mixture is allowed to sit for between approximately 24 hours to 48 hours, depending on the ambient temperature. If the surrounding temperature is very high, i.e., 90° F., the water and sulfuric acid may sit for a longer time, i.e., 48 hours. If the surrounding temperature is lower, i.e., 20° F., the water and sulfuric acid may sit for a shorter period of time, i.e., less than 24 hours.

After the sulfuric acid and water have been sufficiently mixed so as to obtain the desired diluted concentration of sulfuric acid, the corrosion inhibiting agent, preferably Rodine 213 and/or Rodine 95, and one or more surfactants, preferably Igepal CO-630, are added to the sulfuric acid/water mixture. All of the components are mixed together with the stainless steel electric mixer for approximately fifteen (15) minutes, and then the mixture is allowed to sit for approximately one (1 ) hour. After approximately one (1 ) hour, other optional materials, such as mineral oil and/or inert filler materials may be added to the sulfuric acid, water, Rodine, and surfactant(s) mixture. Quality control samples are then taken to check for color, appearance, and specific gravity, so as to determine the percentage of sulfuric acid present in the mixture. If the percentage of sulfuric acid is too low or too high, the composition components may be adjusted to obtain the preferred 85% sulfuric acid concentration. The pH of the composition mixture is below 1.0 and is typically at approximately 0.2 at every stage of the process, due to the high percentage of sulfuric acid present.

Once it is determined that all of the components of the drain opener composition are thoroughly blended, the liquid composition is pumped out of the mixing tanks via a gear transfer pump and into a 100 gallon holding tank. From the holding tank, the composition is then transferred into quart-size, half-gallon and gallon-sized containers with a gravity siphon filler. The containers are made of high density polyethylene. Once the containers are filled, the product is then packaged in cases of varying sizes.

The following Example 1 illustrates the preparation of a preferred drain opener composition of the present invention.

EXAMPLE 1

A preferred drain opener composition of the present invention was prepared as described below, having a composition as shown below.

| COMPONENT | WEIGHT OF COMPOSITION (LBS.) |
|---|---|
| Sulfuric Acid (93% active) | 91.4 |
| Water | 8.0 |
| Igepal CO-630 (100% active) | 0.5 |
| Rodine 213 (100% active) | 0.1 |

*(91.4 multiplied by 93% is 85%)

In preparing the preferred formulation of the drain opener composition of the present invention comprising the above-listed components, initially, the 93% by weight sulfuric acid was diluted with water to a concentration of 85% in a 100 gallon mixing tank. Out of 100 pounds (lbs.) of drain opener composition prepared, sulfuric acid preferably comprised 91.4 lbs. by weight of the composition. To the 91.4 lbs. of sulfuric acid, water in the amount of about 8 lbs. by weight of the composition was slowly added to dilute and lower the 93% concentration of the raw sulfuric acid to about 85% concentration of sulfuric acid. The sulfuric acid and water was initially mixed with a 316 stainless steel electric mixer for approximately thirty (30) minutes. After mixing the sulfuric acid and water with the electric mixer, the sulfuric acid/water mixture was allowed to sit for approximately 24 hours.

After the sulfuric acid and water were sufficiently mixed so as to obtain the desired 85% concentration sulfuric acid, Rodine 213 in the amount of about 0.1 lbs. by weight of the composition, and the nonionic surfactant Igepal CO-630 in the amount of about 0.5 lbs. by weight of the composition, were added to the sulfuric acid/water mixture. All of these components were thoroughly mixed with the stainless steel electric mixer for approximately fifteen (15) minutes. The mixture was then allowed to sit for approximately one hour. After the sulfuric acid, water, Rodine 213 and Igepal CO-630 were sufficiently mixed together, quality control samples were taken to check for color, appearance, and specific gravity, so as to determine the percentage of sulfuric acid present in the mixture.

Once the liquid drain opener composition was thoroughly blended, the liquid composition was pumped out of the mixing tank via a gear transfer pump to a 100 gallon holding tank. A gravity siphon filler was used to transfer the liquid composition from the 100 gallon holding tank into quart-sized containers. Once the containers were filled, the containers were packaged in cases.

The following examples will serve to further illustrate the advantageous properties of the invention:

EXAMPLE 2

Tests were performed using various blends of sulfuric acids and inhibiting agents on cast iron and concrete pieces. Test Methods A (I and II) were performed on cast iron and concrete pieces. Test Method B was performed on concrete pieces only. Test results from Test Methods A (I and II) and B are shown in Table 1–3.

In Test Method A (I and II), as shown in Tables 1 and 2, pieces of cast iron and concrete were tested in four different solutions. Solution 1 comprised a 93% by weight concentration of sulfuric acid with no inhibiting agents, i.e., Rodine 213 or Igepal CO-630. Solution 2 comprised an 85% by weight concentration of sulfuric acid with 0.1% Rodine 213 and without Igepal CO-630. Solution 3 comprised an 85% by weight concentration of sulfuric acid with 0.1% Rodine 213 and with 0.5% Igepal CO-630 added. Solution 4 was a control comprised of water with no sulfuric acid or inhibiting agents.

In Test Method A (I and II), the pieces of cast iron and concrete were immersed in each of the four solutions for two (2) hours each day for three (3) consecutive days, followed by immersion in plain water for three (3) consecutive days. Test Method A (I and II) was conducted for three consecutive weeks.

For both Test Methods A (I and II) and B, between immersions, the cast iron and concrete pieces were placed in an oven set at between 210° F. and 240° F., overnight for drying, and each piece of cast iron or concrete was weighed after being removed from the oven and after remaining at room temperature for 15 minutes.

The results of Test Method A (I), as shown in Table 1, conclude that when cast iron was immersed in the 93% sulfuric acid solution, the piece of cast iron decreased in weight at a higher rate than the piece of cast iron immersed in the 85% sulfuric acid with 0.1% Rodine 213 and 0.5% Igepal CO-630 solution. In addition, the cast iron piece immersed in the 85% sulfuric acid with 0.5% Igepal CO-630 and 0.1% Rodine solution, either decreased in weight at a lower rate or actually increased in weight, when immersed in the water alone for three consecutive days. However, the cast iron piece immersed in the 93% sulfuric acid solution decreased in weight at a faster rate when immersed in the water for three days and did not increase in weight at all. The cast iron piece immersed in the solution of 85% sulfuric acid with 0.1% Rodine 213 but without the Igepal CO-630 performed about the same as the cast iron piece immersed in the 93% sulfuric acid solution.

Specifically, the results of Test Method A (I) show that during the first week of immersions, when the cast iron was immersed in 93% sulfuric acid alone, the effects were almost three times worse than when the cast iron was immersed in 85% sulfuric acid with 0.1% Rodine 213 and 0.5% Igepal CO-630. In addition, when the cast iron was immersed in 85% sulfuric acid with 0.1% Rodine 213 but without the Igepal CO-630, the effects were almost twice as bad as when the cast iron was immersed in 85% sulfuric acid with 0.1% Rodine 213 and 0.5% Igepal CO-630. The results from the second week of immersions show that the cast iron piece immersed in 93% sulfuric acid progressively decreased in weight, while the piece immersed in 85% sulfuric acid with 0.1% Rodine 213 and 0.5% Igepal CO-630 increased in weight. The cast iron piece immersed in plain water for two (2) consecutive weeks progressively decreased in weight.

Thus, it can be concluded from Test Method A (I) involving the cast iron pieces, that the Igepal-treated samples resisted attack by sulfuric acid, while the samples having no Igepal CO-630 treatment were severely attacked. The surfactant Igepal CO-630, when added to an 85% by weight sulfuric acid solution, imparts a micro-coating on the cast iron that acts as a protective agent by penetrating and coating the substrate to prevent significant corrosive effects of sulfuric acid.

The results of Test Method A (II) involving concrete, as shown in Table 2, conclude that the concrete piece immersed in the solution of 93% sulfuric acid decreased in weight at a higher rate than the piece immersed in the solution of 85% sulfuric acid with 0.2% Rodine 213 and 0.5% Igepal CO-630. The concrete piece immersed in the solution of 85% sulfuric acid with 0.1% Rodine 213 and 0.5% Igepal CO-630 either decreased in weight at a lower rate or actually increased in weight when immersed in water for the three consecutive days. However, the piece immersed in the 93% sulfuric acid solution decreased in weight at a faster rate when immersed in water for the three consecutive days. The piece immersed in the 85% sulfuric acid solution with 0.1% Rodine 213 but without the Igepal CO-630 performed about the same as the piece immersed in the 93% sulfuric acid solution.

In the first week of testing with Test Method A (II), the pieces of concrete immersed in 93% sulfuric acid solution and in 85% sulfuric acid with 0.1% Rodine 213 but without 0.5% Igepal CO-630 solution performed about the same, and the concrete piece immersed in the 85% sulfuric acid with 0.1% Rodine 213 and 0.5% Igepal CO-630 solution performed about twice as well as the pieces immersed in the 93% sulfuric acid and the 85% sulfuric acid with 0.1% Rodine 213 but without the Igepal CO-6. The concrete piece immersed in the 85% sulfuric acid with 0.1% Rodine 213 and 0.5% Igepal CO-630 performed about the same as the concrete piece immersed in the control water solution. In the second week of testing with Test Method A (II), the results showed that the concrete piece immersed in the 93% sulfuric acid solution decreased in weight at a greater rate, and the piece immersed in the 85% sulfuric acid with 0.1% Rodine 213 and 0.5% Igepal CO-630 solution decreased in weight at a lower rate. The concrete piece immersed in water alone remained about the same in the second week of testing.

Thus, it can be concluded from the results of Test Method A (II) that the Igepal-treated samples resisted attack by sulfuric acid, while the samples having no Igepal treatment were severely attacked. It appears that a composition containing 0.1% Rodine 213 and 0.5% Igepal CO-630 in 85% sulfuric acid concentration, as in the composition of the present invention, imparts a coating on the concrete that acts as a protective agent by penetrating and coating the substrate to prevent erosion caused by the sulfuric acid.

The test results from Test Method B show that the concrete piece immersed in the solution of 85% sulfuric acid with 0.1% Rodine 213 and 0.5% Igepal CO-630 performed better than either of the pieces immersed in the solution of 93% sulfuric acid or the piece immersed in the solution of 85% sulfuric acid with 0.1% Rodine 213 but without the Igepal CO-630. The concrete piece immersed in the solution of 85% sulfuric acid with 0.1% Rodine 213 and 0.5% Igepal CO-630 lost significantly less weight than either of the concrete pieces immersed in the solution of 93% sulfuric acid or the solution of 85% sulfuric acid with 0.1% Rodine 213 but without the Igepal CO-630.

TABLE 1

| | TEST METHOD A (I) | | | |
|---|---|---|---|---|
| | SOLUTION 1 CAST IRON IN 93% SULFURIC ACID | SOLUTION 2 CAST IRON IN 85% SULFURIC ACID WITH 0.1 % RODINE 213 | SOLUTION 3 CAST IRON IN 85% SULFURIC ACID WITH 0.5% IGEPAL CO-630 AND WITH 0.1% RODINE 213 | SOLUTION 4 CAST IRON IN WATER-NO ACID |
| PERCENT CHANGE | | | | |
| I WEEK 1* | −0.97 | −0.62 | −0.38 | −0.03 |
| I WEEK 2** | −0.03 | +0.01 | +0.06 | −0.04 |
| II WEEK 1* | −1.77 | −0.77 | −0.58 | 0.04 |
| II WEEK 2** | −0.05 | −0.11 | 0.01 | −0.08 |
| III WEEK 1* | −1.01 | −0.54 | −0.44 | −0.09 |
| III WEEK 2** | 0.04 | −0.25 | 0.19 | −0.07 |
| AVERAGE WEEK I* | −1.25 | −0.64 | −0.47 | −0.03 |
| AVERAGE WEEK II** | −0.01 | −0.12 | 0.07 | −0.06 |

*In Acid.
**In Water.

TABLE 2

| | TEST METHOD A (II) | | | |
|---|---|---|---|---|
| | SOLUTION 1 CONCRETE IN 93% SULFURIC ACID | SOLUTION 2 CONCRETE IN 85% SULFURIC ACID WITH 0.1% RODINE 213 | SOLUTION 3 CONCRETE IN 85% SULFURIC ACID WITH 0.5% IGEPAL CO-630 AND WITH 0.1% RODINE 213 | SOLUTION 4 CONCRETE IN WATER-NO ACID |
| PERCENT CHANGE | | | | |
| I WEEK 1* | −0.89 | −1.00 | −0.64 | −0.55 |
| I WEEK 2** | −0.56 | −0.49 | −0.39 | −0.27 |
| II WEEK 1* | −0.48 | −0.79 | 0.00 | 0.20 |
| II WEEK 2** | −1.17 | −0.61 | −0.26 | −0.26 |
| III WEEK 1* | −1.07 | −1.19 | −0.64 | −0.41 |
| III WEEK 2** | −1.44 | −1.92 | −1.10 | −1.33 |
| AVERAGE WEEK I* | −0.81 | −0.99 | −0.43 | −0.25 |
| AVERAGE WEEK II** | −1.06 | −1.01 | −0.58 | −0.62 |

*In Acid.
**In Water.

EXAMPLE 3

In Test Method B, as shown in Table 3, pieces of concrete were tested with three different solutions. Solution 1 comprised a 93% by weight concentration of sulfuric acid with no inhibiting agents, i.e., Rodine 213 or Igepal CO-630. Solution 2 comprised an 85% by weight concentration of sulfuric acid with 0.1% Rodine 213 but without the Igepal CO-630. Solution 3 comprised an 85% by weight concentration of sulfuric acid with 0.1% Rodine 213 and with 0.5% Igepal CO-630. In Test Method B, pieces of concrete were immersed in each of the three solutions for 10 minutes for one day and then immersed in water alone for two (2) hours on two (2) consecutive days. Three trial tests were performed under these conditions.

Thus, it appears that the addition of 0.1% Rodine 213 and 0.5% Igepal CO-630 in 85% sulfuric acid concentration, imparts a coating on the concrete surfaces that acts as a protective agent by penetrating and coating the substrate to prevent significant adverse effects and erosion caused by sulfuric acid.

It will be understood that the invention may be embodied in other specific forms by one of ordinary skill in the art without departing from its spirit or central characteristics. The present example and embodiment is thus to be considered as illustrative and not restrictive, and the invention is not intended to be limited to the details of the listed embodiments. Rather, the invention is defined by the claims, and as broadly as the prior art will permit.

TABLE 3

| TEST METHOD B | SOLUTION 1 CONCRETE IN 93% SULFURIC ACID | SOLUTION 2 CONCRETE IN 85% SULFURIC ACID WITH 0.1% RODINE 213 | SOLUTION 3 CONCRETE IN 85% SULFURIC ACID WITH 0.5% IGEPAL CO-630 AND WITH 0.1% RODINE 213 |
|---|---|---|---|
| PERCENT CHANGE | | | |
| I*** | −0.68 | −1.15 | −0.44 |
| II*** | −0.18 | −0.17 | 0.00 |
| III*** | −0.81 | −1.19 | −0.71 |
| AVERAGE | −0.56 | −0.84 | −0.38 |

What is claimed is:

1. A liquid drain opener composition comprising:
from about 70% by weight to about 93% by weight sulfuric acid;
from about 1% by weight to about 23% weight water;
from about 0.01% by weight to about 5% by weight of at least one corrosion inhibiting agent; and
from about 0.5% by weight to about 28.99% by weight of at least one surfactant selected from the group consisting of nonionic surfactants, cationic surfactants, amphoteric surfactants, fluorinated surfactants and mixtures thereof.

2. The drain opener composition of claim 1 including a mineral oil of about less than 1% by weight.

3. The drain opener composition of claim 1 wherein said sulfuric acid is in an amount of about 85% by weight of said composition.

4. The drain opener composition of claim 1 wherein said water is in an amount of about 8% by weight of said composition.

5. The drain opener composition of claim 1 wherein said corrosion inhibiting agent is in an amount of about 0.1% by weight of said composition.

6. The drain opener composition of claim 1 wherein said corrosion inhibiting agent is a cationic corrosion inhibitor.

7. The drain opener composition of claim 1 wherein said corrosion inhibiting agent comprises the components of substituted triazine at about 40–50% by weight, hydrochloric acid at about less the 15% by weight, thiourea at about 1–5% by weight, formaldehyde at about less than 1% by weight, and orthotoluidine at about less than 1% by weight.

8. The drain opener composition of claim 1 wherein said surfactant is a nonionic surfactant comprising nonylphenol (from about 4 mols to about 100 mols ethylene oxide) polyethoxylate.

9. The drain opener composition of claim 1 wherein said surfactant is a cationic surfactant comprising cocohydroxyethyl imidazoline or oleyl imidazoline.

10. The drain opener composition of claim 1 wherein said surfactant is an amphoteric surfactant comprising cocamidopropyl betaines or alkyl imidazoline.

11. The drain opener composition of claim 1 wherein said surfactant is a fluorocarbon surfactant selected from the group consisting of anionic, ammonium perfluoroalkyl sulfonates; anionic amine perfluoroalkyl sulfonates; cationic, fluorinated alkyl quaternary ammonium iodides; nonionic, fluorinated alkyl polyoxyethylene ethanols; and nonionic fluorinated alkyl alkoxylate.

12. A drain opener composition comprising:
about 91.4 parts by weight sulfuric acid;
about 8 parts by weight water;
about 0.1 parts by weight of at least one corrosion inhibiting agent; and
0.5 parts by weight of at least one surfactant selected from the group consisting of nonionic surfactants, cationic surfactants, amphoteric surfactants, fluorinated surfactants and mixtures thereof.

13. The drain opener composition of claim 12 wherein said corrosion inhibiting agent is a cationic corrosion inhibitor.

14. The drain opener composition of claim 12 wherein said corrosion inhibiting agent comprises the components of substituted triazine at about 40–50 % by weight, hydrochloric acid at about less than 15% by weight, thiourea at about 1–5% by weight, formaldehyde at about less than 1% by weight, and orthotoluidine at about less than 1% by weight.

15. The drain opener composition of claim 12 wherein said surfactant is a nonionic surfactant comprising nonylphenol (from about 4 mols to about 100 mols ethylene oxide) polyethoxylate.

* * * * *

UNITED STATES PATENT AND TRADEMARK OFFICE

CERTIFICATE OF CORRECTION

PATENT NO. : 5,429,764

DATED : July 4, 1995

INVENTOR(S) : Eftichios Van Vlahakis et al.

It is certified that error appears in the above-indentified patent and that said Letters Patent is hereby corrected as shown below:

Column 13, Claim 7, line 47, delete "the" and insert --than--.

Column 14, Claim 11, line 25, after "anionic" insert --,--.

Signed and Sealed this

Twenty-sixth Day of December, 1995

*Attest:*

Bruce Lehman

BRUCE LEHMAN

*Attesting Officer*

*Commissioner of Patents and Trademarks*